US005575706A

United States Patent [19]

Tsai et al.

[11] Patent Number: 5,575,706

[45] Date of Patent: Nov. 19, 1996

[54] CHEMICAL/MECHANICAL PLANARIZATION (CMP) APPARATUS AND POLISH METHOD

[75] Inventors: Chia S. Tsai; Pin-Nan Tseng, both of Hsin-chu, Taiwan

[73] Assignee: Taiwan Semiconductor Manufacturing Company Ltd., Hsin-Chu, Taiwan

[21] Appl. No.: 585,068

[22] Filed: Jan. 11, 1996

[51] Int. Cl.[6] ..... B24B 1/00

[52] U.S. Cl. ..... 451/41; 451/285; 451/36; 216/88; 156/636.1

[58] Field of Search ..... 451/41, 285, 287, 451/288, 289, 36, 37, 39, 93; 216/88, 89; 156/636.1

[56] References Cited

U.S. PATENT DOCUMENTS

| | | | |
|---|---|---|---|
| 4,821,466 | 4/1989 | Kato et al. | 451/36 |
| 5,023,203 | 7/1991 | Doy et al. | 451/287 |
| 5,078,801 | 1/1992 | Malik | 451/285 |
| 5,234,867 | 8/1993 | Schultz et al. | 437/225 |
| 5,240,552 | 8/1993 | Yu et al. | 156/636 |
| 5,272,117 | 12/1993 | Roth et al. | 216/88 |
| 5,449,313 | 9/1995 | Kordonsky et al. | 451/36 |
| 5,492,594 | 2/1996 | Burke et al. | 451/287 |

*Primary Examiner*—James G. Smith
*Assistant Examiner*—Dona C. Edwards
*Attorney, Agent, or Firm*—George O. Saile

[57] ABSTRACT

An improved and new apparatus and process for chemical/mechanical planarization (CMP) of a substrate surface, wherein the slurry concentration between the wafer and polishing pad is controlled through the application of an electric field between the wafer carrier and polishing platen, has been developed. The result is an increased polish removal rate and better uniformity of the planarization process.

35 Claims, 3 Drawing Sheets

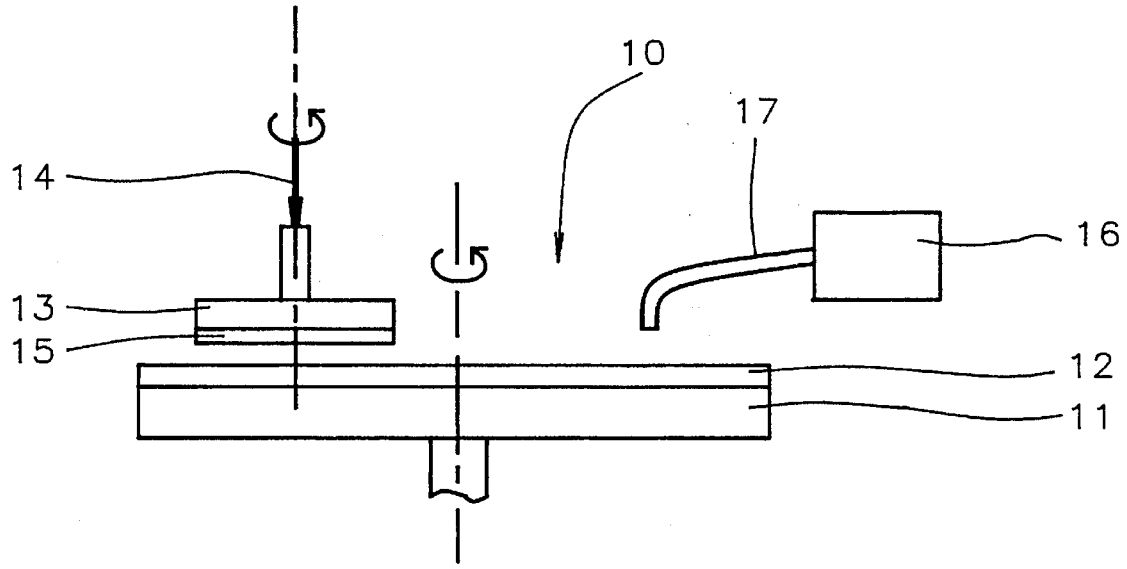
FIG. 1 – Prior Art
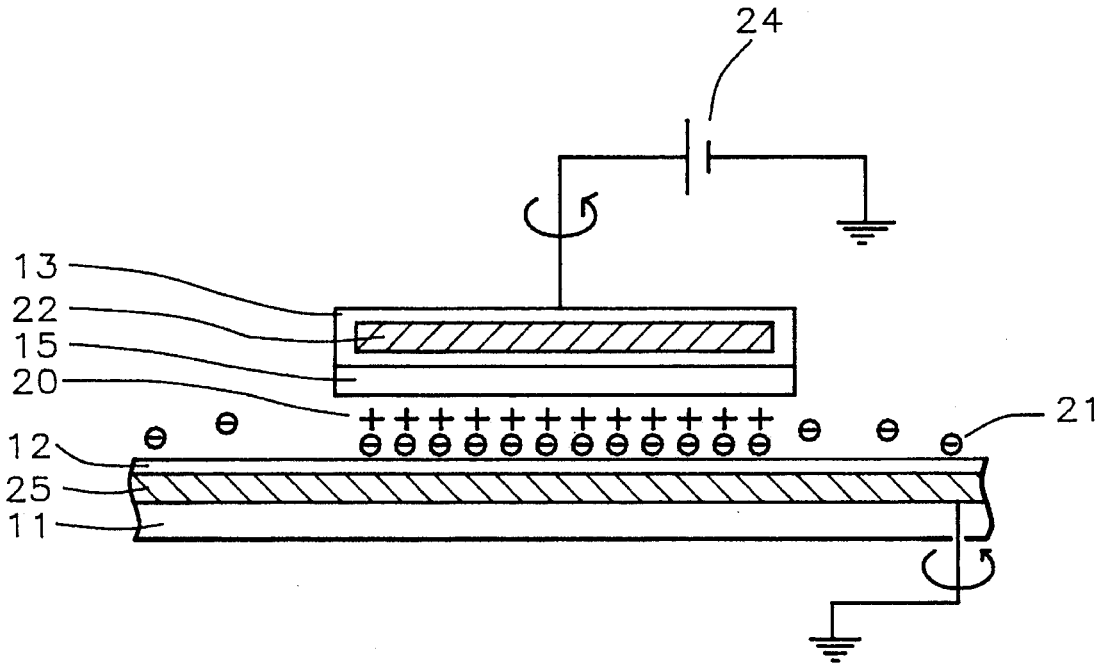
FIG. 2a

CHEMICAL/MECHANICAL PLANARIZATION (CMP) APPARATUS AND POLISH METHOD

BACKGROUND OF THE INVENTION

1. Field of the Invention

This invention relates to an apparatus and method for chemical/mechanical planarization (CMP) of a semiconductor wafer. More specifically, the invention is directed to an apparatus and method which increases the polish removal rate and the uniformity of the planarization process.

2. Description of Related Art

In the fabrication of semiconductor components, metal conductor lines are used to interconnect the many components in device circuits. As wiring densities in semiconductor circuit chips increase, multiple wiring levels are required to achieve interconnection of the devices, and planarization of the interlevel dielectric becomes a critical step in the fabrication process. The technology requires that the device interconnection lines be formed over a substrate containing device circuitry. These interconnection lines are typically metal or a conductor and serve to electrically interconnect the discrete circuit devices. These metal connecting lines are further insulated from the next interconnection level by thin layers of insulating material formed by, for example, chemical vapor deposition (CVD) of oxide. In order to interconnect metal lines of different wiring levels, holes are formed in the insulating layers to provide electrical access therebetween. In such wiring processes, it is desirable that the insulating layers have a smooth topography and that the thickness of the polished insulating layer be uniform across the semiconductor substrate.

Recently chemical/mechanical polishing (CMP) has been developed for providing smooth insulator topographies. Briefly, the process involves holding and rotating a thin, flat wafer of the semiconductor material against a wetted polishing surface under controlled chemical, pressure, and temperature conditions. FIG. 1 shows a conventional CMP apparatus, 10, having a rotatable polishing platen, 11, and a polishing pad, 12, mounted to the polishing platen, 11; a rotatable wafer carrier, 13, adapted so that a force indicated by arrow, 14, is exerted on semiconductor wafer, 15; a chemical slurry supply system comprising a temperature controlled reservoir, 16, and conduit, 17, which dispenses the slurry onto the polishing pad, 12. A chemical slurry containing a polishing agent, such as alumina or silica, is used as the abrasive material. Additionally, the chemical slurry contains selected chemicals which etch various surfaces of the wafer during processing. The combination of mechanical and chemical removal of material during polishing results in superior planarization of the polished surface. In this process it is important to remove a sufficient amount of material to provide a smooth surface, without removing an excessive amount of underlying materials. Thus, it is important that the polish removal rate across the wafer be uniform; i.e. the polish removal rate near the edge of the wafer is the same as the polish removal rate near the center of the wafer.

Parameters which affect:the polish removal rate are downward pressure on the wafer, rotational speeds of the polishing platen and wafer carrier, slurry particle density and size, slurry composition and temperature, and polishing pad composition. Adjustment of these parameters permits control of the polishing and planarization processes; however, the problem of non-uniform polish removal rate continues to plague conventional CMP processes because, in general, removal rates tend to be higher at the wafer edge than at the wafer center because wafer rotation causes the wafer edge region to move at a higher linear speed than the wafer central region.

Improvements in CMP processes to control uniformity have been invented, as shown in the following patents. U.S. Pat. No. 5,234,867 entitled "Method For Planarizing Semiconductor Wafers With A Non-Circular Polishing Pad" granted Aug. 10, 1993 to Laurence D. Schultz et al describes a polishing method whereby the uniformity of removal rate across a substrate is improved by controlling the time duration in which the polishing pad is in contact with the outer regions of the substrate. U.S. Pat. No. 5,240,552 entitled "Chemical Mechanical Planarization (CMP) Of A Semiconductor Wafer Using Acoustical Waves For In-situ End Point Detection" granted Aug. 31, 1993 to Chris C. Yu et al directs acoustical waves at the wafer during CMP and through analysis of the reflected waveform controls the planarization process to improve the uniformity of the process.

The present invention is directed to a novel method and apparatus for controlling the polish removal rate and uniformity of polish removal rate across a semiconductor wafer during chemical/mechanical planarization (CMP).

SUMMARY OF THE INVENTION

One object of the present invention is to provide an improved and new apparatus and process for chemical/mechanical planarization (CMP) of a semiconductor wafer surface, wherein the polish removal rate is controlled through the application of an electric field between the semiconductor wafer carrier and the polishing pad.

Another object of the present invention is to provide a new and improved apparatus and process for chemical/mechanical planarization (CMP) of a semiconductor wafer surface, wherein application of an electric field between selected regions of the semiconductor wafer carrier and polishing pad affects the polish removal rates in a manner which improves the uniformity of material removal across the entire semiconductor wafer surface.

A further object of the present invention is to provide a new and improved apparatus and process for chemical/mechanical planarization (CMP) of a semiconductor wafer surface, wherein the uniformity of polish removal rate is controlled through the application of bi-directional electric fields between the semiconductor wafer carrier and the polishing pad.

The novel features of the polishing apparatus in accordance with the invention comprise, applying an electric field between the wafer carrier and polishing platen as a means of controlling the concentration of the polishing slurry across the surface of the semiconductor wafer being polished and thereby increasing the polish removal rate and improving the uniformity of polish removal rate across the semiconductor wafer surface. In an illustrative embodiment, apparatus for carrying out the method of the invention comprises: a rotatable polishing platen for chemically/mechanically planarizing (CMP) a surface of a semiconductor wafer; a reservoir for a polishing slurry and a means to dispense the slurry onto the polishing pad; an electrode embedded in the rotatable platen; a rotatable wafer carrier and means for holding the surface of the semiconductor wafer in juxtaposition relative to the rotating polishing pad with an applied pressure between the wafer carrier and the polishing pad; at least one electrode embedded in the rotatable wafer carrier; and a means to apply an electric field between the electrode embedded in the polishing platen and the electrode embedded ink the wafer carrier.

BRIEF DESCRIPTION OF THE DRAWINGS

The object and other advantages of this invention are best described in the preferred embodiments with reference to the attached drawings that include:

FIG. 1, which schematically, in cross-sectional representation, illustrates a conventional chemical/mechanical polishing (CMP) apparatus.

FIGS. 2A and 2B, which schematically, in cross-sectional representation, illustrate an embodiment of the invention, in which a mono-directional electric field is imposed between the wafer carrier and polishing pad.

DESCRIPTION OF THE PREFERRED EMBODIMENTS

The new and improved CMP apparatus and method of planarizing the surface of a semiconductor substrate, using chemical/mechanical polishing (CMP), which results in improved uniformity of removal rate across the substrate, will now be described in detail. The apparatus and method can be used for planarizing insulator surfaces, such as silicon oxide or silicon nitride, deposited by chemical vapor deposition or other means, over semiconductor devices and/or conductor interconnection wiring patterns. Only the specific areas unique to understanding this invention will be described in detail.

In usual practice of chemical/mechanical polishing (CMP), the abrasive material in the slurry is silica or alumina. It is known that colloidal silica, as dispersed in the polishing slurry has optimum stability at an alkaline pH, between about ph=8 and pH=11, because a negative charge is then formed on the surface of the colloidal silica particles. See, for example, U.S. Pat. No. 5,078,801 entitled "Post-Polish Cleaning Of Oxidized Substrates By Reverse Colloidation" granted Jan. 7, 1992. The negative surface charges on the colloids of silica create electrostatic repulsion between the particles, prevent agglomeration, and stabilize the colloid.

Figure 2B:
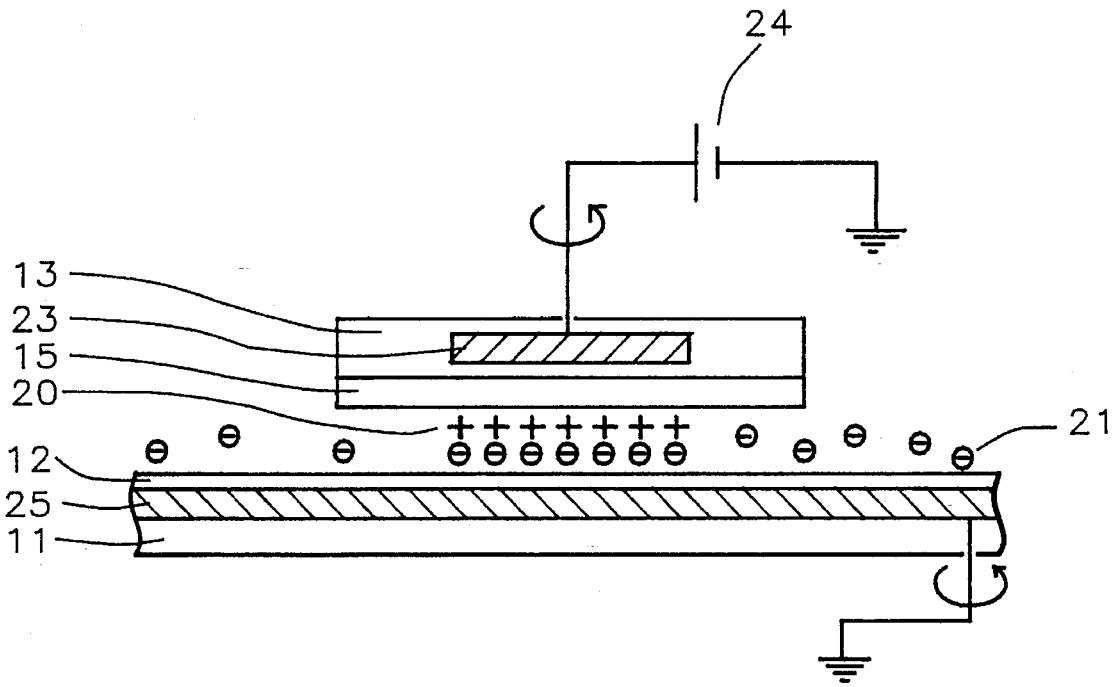

In the present invention a positive electrical potential, 24, is imposed between the electrode, 22 or 23, embedded in the wafer carrier, 13, and the grounded electrode, 25, embedded in the polishing platen, 11, as shown in FIGS. 2A and 2B. The presence of the electric potential, 24, causes an electric field between the wafer carrier, 13, and the polishing platen, 11, and a build-up of positive (+) charge, 20, on the insulator surface of the semiconductor wafer, 15. This positive charge, 20, attracts negatively charged collodial silica, 21, and thereby increases the slurry concentration between the semiconductor wafer, 15, and the polishing pad, 12, resulting in an increased polish removal rate as a result of the applied electrical potential, 24. In FIG. 2A, where the electrode, 22, embedded in the wafer carrier has a diameter substantially the same as the diameter of the semiconductor wafer, 15, the electrical potential, 24, causes a substantially uniform field across the wafer and results in an increased polish removal rate across the entire wafer. In FIG. 2B, by limiting the diameter of the carrier electrode, 23, the electric field is applied only across the central area of the wafer, thereby increasing the slurry concentration in the central region of the wafer and results in an increased polish removal rate in this central region. The result is an improved uniformity of removal rate across the entire wafer, because the electric field increases the polish removal rate in the central region and compensates for the usually reduced polish removal rate in the central region.

Figure 3:
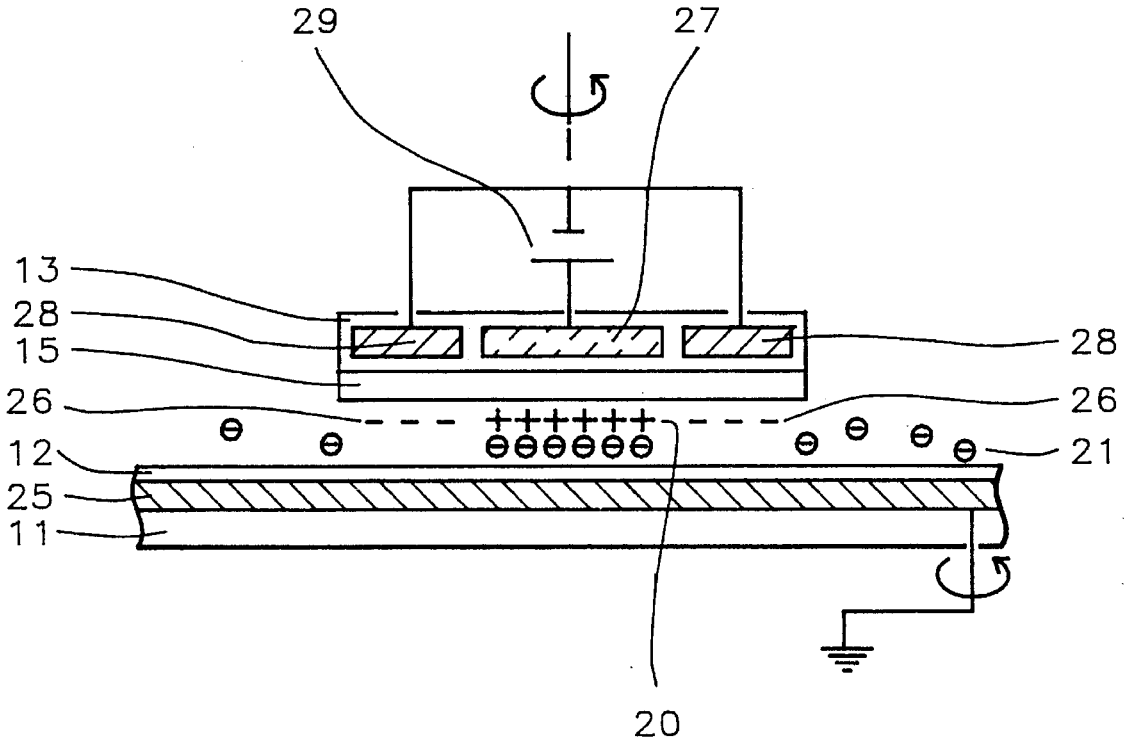
FIG. 3, which schematically, in cross-sectional representation, illustrates another embodiment of the invention, in which bi-directional electric fields are imposed between the wafer carrier and polishing pad.

In a second embodiment of the present invention, bi-directional electric fields are imposed between the wafer carrier, 13, and the polishing pad, 12, as shown in FIG. 3. At least two concentric electrodes, one central circular electrode, 27, having a diameter which is a fraction of the diameter of the semiconductor wafer, 15, and at least one additional electrode, 28, having an annular shape with an outer diameter substantially the same as the diameter of the semiconductor wafer and an inner diameter greater than the diameter of electrode, 27, are embedded in the wafer carrier, 13. Electrical potential, 29, establishes bi-directional electric fields so that a build-up of negative (–) charge, 26, occurs on the insulator surface near the outer edge of the semiconductor wafer, 15, and a build-up of positive (+) charge, 20, occurs on the insulator surface near the center of the semiconductor wafer, 15. The negative charge, 26, repels negatively charged collodial silica, 21, and causes a reduction of slurry concentration between the semiconductor wafer, 15, and the polishing pad, 12, near the outer edge of the wafer and results in decreased polish removal rate in this region. The positive charge, 20, attracts negatively charged collodial silica, 21, and thereby increases the slurry concentration between the semiconductor wafer, 15, and the polishing pad, 12, near the center of the wafer and results in increased polish removal rate in this central region. This embodiment allows tailoring of the polish removal rate as a function of field region and results in improved uniformity of polish removal rate across the entire semiconductor wafer.

Figure 4:
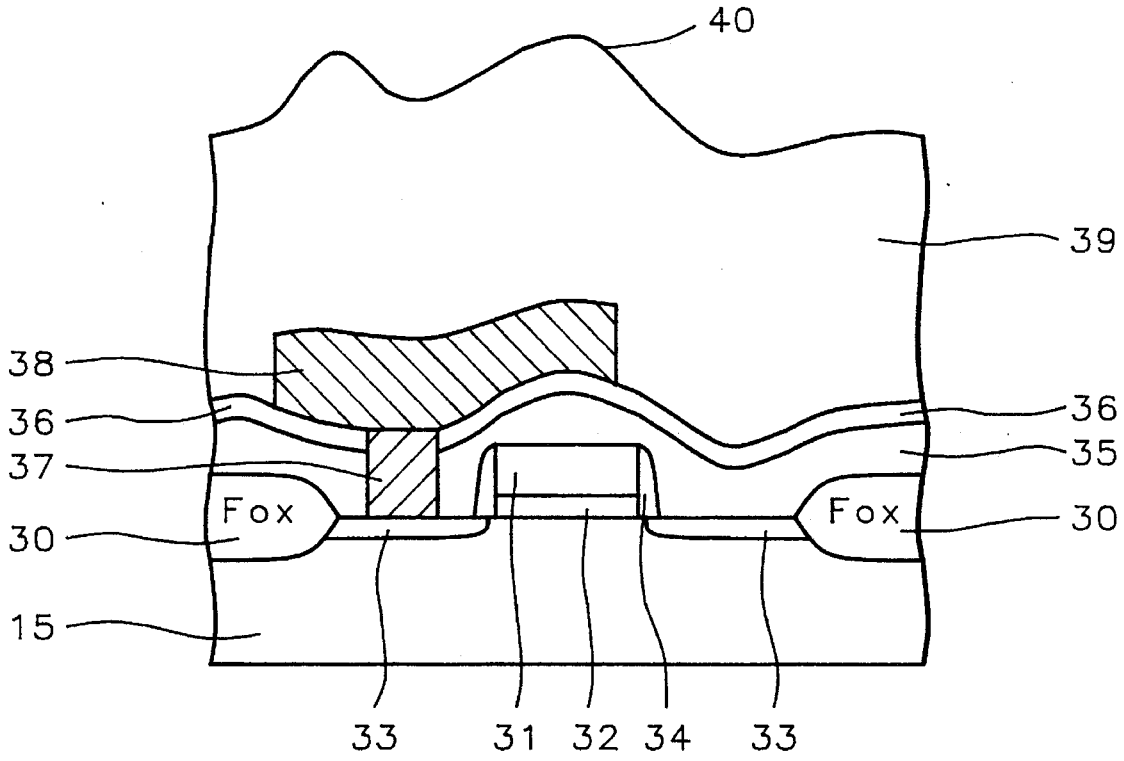
FIGS. 4–5, which schematically, in cross-sectional representation, illustrate planarization of the surface of a semiconductor circuit by chemical/mechanical polishing.
Figure 5:
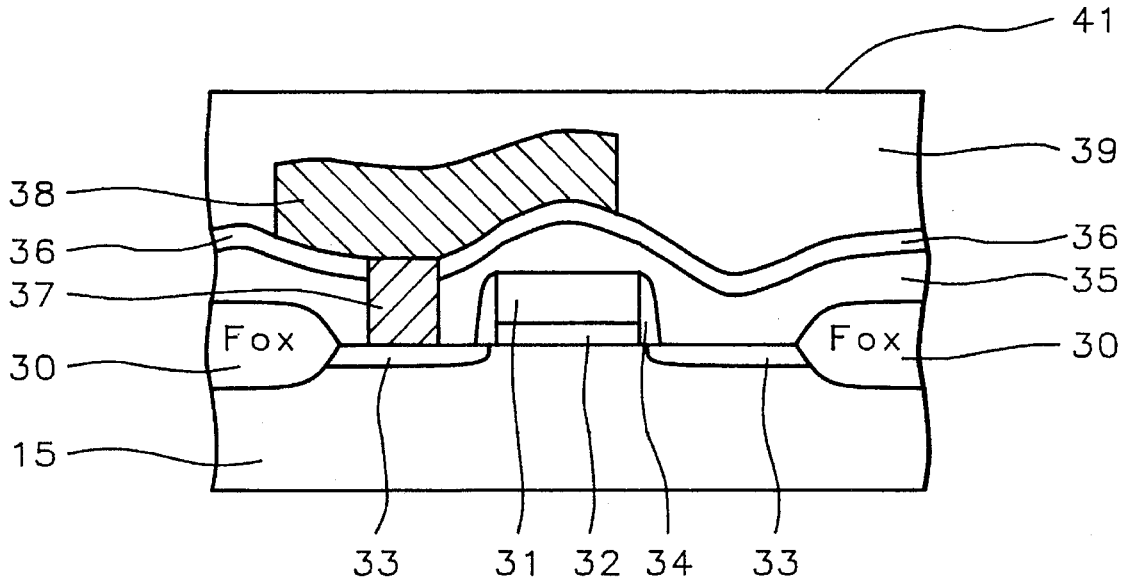

FIGS. 4 and 5, schematically in cross-sectional representation, show the chemical/mechanical planarization (CMP) of a semiconductor wafer containing a metallized MOSFET device onto which has been deposited an overlayer of silicon oxide. A typical NFET, (N-type Field Effect Transistor) device, as shown in FIG. 4, consists of a semiconductor wafer, 15, composed of P-type, single crystal silicon with a <100> orientation; a thick field oxide region, 30, (FOX); a polysilicon gate, 31; gate oxide, 32; source and drain regions, 33; sidewall spacers, 34; LPCVD deposited layers of silicon oxide, 35, and silicon nitride, 36; interlevel connecting plug, 37; conducting interconnection pattern, 38; and LPCVD deposited overlayer of silicon oxide, 39. Deposition of the LPCVD layer of silicon oxide, 39, is substantially conformal to the underlying topography and results in a rough surface topography, 40. Planarization of the surface topography, 40, shown in FIG. 4, is performed using the new and improved apparatus of this invention for chemical/mechanical planarization (CMP), and results in a substantially planar oxide surface, 41, as shown in FIG. 5.

The new and improved method of CMP planarization utilizing the new and improved CMP apparatus illustrated in an embodiment, shown in FIG. 2A, will now be described in detail. Referring to FIG. 1, a polishing slurry consisting of silica and $H_2O$, contained in reservoir, 16, is controlled in the temperature range between about 20° to 30° C., and is dispensed through conduit, 17, so as to saturate polishing pad, 12. Now referring to FIG. 2A, which illustrates an embodiment of the new and improved CMP apparatus, the semiconductor wafer, 15, is placed onto the wafer carrier, 13, with the silicon oxide layer face down against the polishing pad, 12. A positive potential, 24, between about 1 to 10 volts is applied between the electrode, 22, embedded in the wafer carrier, 13, and the electrode, 25, embedded in the polishing platen, 11. The polishing platen is rotated at a speed between about 10 to 70 rpm and the wafer carrier is rotated at a speed between about 25 to 90 rpm. A pressure of between about 2 to 12 psi is applied between the wafer carrier, 13, and the polishing pad, 12. Polishing proceeds until the desired surface smoothness is achieved.

A new and improved method of CMP planarization may also be carried out through the use of the new and improved CMP apparatus illustrated in the embodiment, shown in FIG. 3. First, referring to FIG. 1, a polishing slurry consisting of silica and $H_2O$, contained in reservoir, 16, is controlled in the temperature range between about 20° to 30° C., and is dispensed through conduit, 17, so as to saturate polishing pad, 12. Now referring to FIG. 3, the semiconductor wafer, 15, is placed onto the wafer carrier, 13, with the silicon oxide layer face down against the polishing pad, 12. A positive potential, 29, between about 1 to 10 volts is applied between the central circular electrode, 29, and the annular electrode, 28. The polishing platen is rotated at a speed between about 10 to 70 rpm and the wafer carrier is rotated at a speed between about 25 to 90 rpm. A pressure of between about 2 to 12 psi is applied between the wafer carrier, 13, and the polishing pad, 12. Polishing proceeds until the desired surface smoothness is achieved.

While the invention has been particularly shown and described with reference to the preferred embodiments thereof, it will be understood by those skilled in the art that various changes in form and details may be made without departing from the spirit and scope of the invention.

What is claimed is:

1. An apparatus for planarizing semiconductor wafers comprising:

a rotatable platen and polishing pad for chemical/mechanical polishing (CMP) a surface of a semiconductor wafer;

a reservoir for a polishing slurry and means to dispense the slurry onto the polishing pad;

an electrode embedded in said rotatable platen;

a rotatable wafer carrier and means for holding the surface of the semiconductor wafer in juxtaposition relative to said rotating polishing pad with an applied pressure between the wafer carrier and the polishing pad;

at least one electrode embedded in said rotatable wafer carrier; and a means to apply an electric field between said electrode embedded in said rotatable platen and said electrode embedded in said rotatable wafer carrier.

2. The apparatus of claim 1, wherein said polishing slurry comprises silica and $H_2O$ at a pH between about pH=10 to pH=11.

3. The apparatus of claim 1, wherein said rotatable platen is rotated at a speed between about 10 to 70 rpm.

4. The apparatus of claim 1, wherein said rotatable wafer carrier is rotated at a speed between about 25 to 90 rpm.

5. The apparatus of claim 1, wherein said applied pressure between the wafer carrier and the polishing pad is between about 2 to 12 psi.

6. The apparatus of claim 1, wherein said electric field between said electrode embedded in said rotatable platen and said electrode embedded in said rotatable wafer carrier is a result of an applied potential between about 1 to 10 volts, between said electrode in said rotatable platen and said electrode in said rotatable wafer carrier.

7. The apparatus of claim 1, wherein said electrode embedded in said rotatable platen has substantially the same diameter as the platen.

8. The apparatus of claim 1, wherein said electrode embedded in said rotatable wafer carrier has substantially the same diameter as the wafer carrier.

9. The apparatus of claim 1, wherein said electrode embedded in said rotatable wafer carrier has a diameter which is a fraction of the diameter of the wafer carrier.

10. An apparatus for planarizing semiconductor wafers comprising:

a rotatable platen and polishing pad for chemical/mechanical polishing (CMP) a surface of a semiconductor wafer;

a reservoir for a polishing slurry and means to dispense the slurry onto the polishing pad;

an electrode embedded in said rotatable platen;

a rotatable wafer carrier and means for holding the surface of the semiconductor wafer in juxtaposition relative to said rotating polishing pad with an applied pressure between the wafer carrier and the polishing pad;

at least two electrodes embedded in said rotatable wafer carrier; and a means to apply bidirectional electric fields between said electrode embedded in said rotatable platen and said electrodes embedded in said rotatable wafer carrier.

11. The apparatus of claim 10, wherein said polishing slurry comprises silica and $H_2O$ at a pH between about pH=10 to pH=11.

12. The apparatus of claim 10, wherein said rotatable platen is rotated at a speed between about 10 to 70 rpm.

13. The apparatus of claim 10, wherein said rotatable wafer carrier is rotated at a speed between about 25 to 90 rpm.

14. The apparatus of claim 10, wherein said applied pressure between the wafer carrier and the polishing pad is between about 2 to 12 psi.

15. The apparatus of claim 10, wherein said electrode embedded in said rotatable platen has substantially the same diameter as the platen.

16. The apparatus of claim 10, wherein a first electrode embedded in said rotatable wafer carriers has a circular shape with a diameter which is a fraction of the diameter of the wafer carrier and a second electrode embedded in said rotatable wafer carrier has an annular shape with an outer diameter substantially the same as the diameter of said semiconductor wafer and an inner diameter greater than the diameter of said first electrode.

17. The apparatus of claim 10, wherein said bi-directional electric fields between said electrode embedded in said rotatable platen and said electrodes embedded in said rotatable wafer carrier are a result of an applied potential between about 1 to 10 volts, between said first electrode embedded in said rotatable wafer carrier and said second electrode embedded in said rotatable wafer carrier.

18. A method for fabricating a planarized layer of dielectric material on a semiconductor substrate containing a structure, comprising the steps of:

providing said structure on said semiconductor substrate;

depositing a layer of dielectric material onto said semiconductor substrate containing said structure;

planarizing said layer of dielectric material by holding said semiconductor substrate on a wafer carrier into which is embedded at least one electrode, and rotating the wafer carrier, in the presence of a polishing slurry, against a polishing pad attached to a rotating platen into which is embedded an electrode;

applying pressure between the rotating wafer carrier and rotating platen; and applying an electric field between said electrode embedded in said rotatable platen and said electrode embedded in said rotatable wafer carrier.

19. The method of claim 18, wherein said structure is an active device.

20. The method of claim 18, wherein said structure is an interconnection pattern of conducting material.

21. The method of claim 18, wherein said structure comprises both active devices and an interconnection pattern of conducting material.

22. The method of claim 19, wherein said active device is a NFET or PFET MOS device.

23. The method of claim 20, wherein said interconnection pattern of conducting material, is aluminum having a thickness between about 4000 to 8080 Angstroms.

24. The method of claim 18, wherein said layer of dielectric material is silicon oxide deposited using LPCVD processing, at a temperature between about 300° to 500° C., to a thickness between about 8000 to 11,000 Angstroms, using TEOS at a flow between about 400 to 1600 sccm.

25. The method of claim 18, wherein said polishing slurry comprises silica and $H_2O$, controlled in the temperature range between about 20° to 30° C.

26. The method of claim 18, wherein said rotating wafer carrier is rotated:in a range between about 25 to 90 rpm.

27. The method of claim 18, wherein said rotating platen is rotated in a range between about 10 to 70 rpm.

28. The method of claim 18, wherein said applied pressure between the wafer carrier and platen is in a range between about 2 to 12 psi.

29. The method of claim 18, wherein said electric field between said electrode embedded in said rotatable platen and said electrode embedded in said rotatable wafer carrier is a result of an applied potential between about 1 to 10 volts, between said electrode in said rotatable platen and said electrode in said rotatable wafer carrier.

30. The method of claim 18, wherein said electrode embedded in said rotatable platen has substantially the same diameter as the platen.

31. The method of claim 18, wherein said electrode embedded in said rotatable wafer carrier has substantially the same diameter as the wafer carrier.

32. The method of claim 18, wherein said electrode embedded in said rotatable wafer carrier has a diameter which is a fraction of the diameter of the wafer carrier.

33. The method of claim 18, wherein a first electrode embedded in said rotatable wafer carrier has a circular shape with a diameter which is a fraction of the diameter of the wafer carrier and a second electrode embedded in said rotatable wafer carrier has an annular shape with an outer diameter substantially the same as the diameter of said semiconductor wafer and an inner diameter greater than the diameter of said first electrode.

34. The method of claim 33, wherein bi-directional electric fields are applied between said electrode embedded in said rotatable platen and said electrodes embedded in said rotatable wafer carrier.

35. The method of claim 34, wherein said bi-directional electric fields are a result of an applied potential between about 1 to 10 volts, between said first electrode embedded in said rotatable wafer carrier and said second electrode embedded in said rotatable wafer carrier.

* * * * *